United States Patent [19]

Seal

[11] Patent Number: 5,041,104

[45] Date of Patent: Aug. 20, 1991

[54] NONWOVEN MATERIALS

[75] Inventor: Michael J. Seal, Dunblane, Wales

[73] Assignee: Bonar Carelle Limited, Dundee, Scotland

[21] Appl. No.: 224,812

[22] Filed: Jul. 27, 1988

[30] Foreign Application Priority Data

Jul. 27, 1987 [GB] United Kingdom ..... 8717729

[51] Int. Cl.[5] ..... A61F 13/15

[52] U.S. Cl. ..... 604/367; 428/213; 428/283; 428/284; 428/288; 428/402

[58] Field of Search ..... 428/288, 283, 402, 284, 428/213; 604/367

[56] References Cited

U.S. PATENT DOCUMENTS

| | | | |
|---|---|---|---|
| 2,880,112 | 3/1959 | Drelich | 117/37 |
| 2,880,113 | 3/1959 | Drelich | 117/37 |
| 3,561,447 | 2/1971 | Alexander | 128/290 |
| 3,804,092 | 4/1974 | Tunc | 128/284 |
| 4,332,253 | 6/1982 | Schoots | 128/287 |
| 4,356,229 | 10/1982 | Brodnyan et al. | 428/288 |
| 4,377,615 | 3/1983 | Suzuki et al. | 428/213 |
| 4,559,050 | 12/1985 | Iskra | 604/368 |
| 4,573,989 | 3/1986 | Karami et al. | 604/381 |
| 4,610,915 | 9/1986 | Crenshaw et al. | 428/219 |
| 4,652,484 | 3/1987 | Shiba et al. | 428/286 |
| 4,704,112 | 11/1987 | Suzuki et al. | 604/378 |

FOREIGN PATENT DOCUMENTS

| | | |
|---|---|---|
| 0202472 | 11/1986 | European Pat. Off. . |
| 0205242 | 12/1986 | European Pat. Off. . |
| 0269380 | 6/1988 | European Pat. Off. . |
| 2175024 | 11/1986 | United Kingdom . |
| 2175025 | 11/1986 | United Kingdom . |

OTHER PUBLICATIONS

Finnwad Ltd. Trade Pamphlet on "Multiwebb".

Meyer et al., Production of Laminates and Nonwovens by Powder Bonding, paper presented at Oct. 1985 Insight Meeting in Toronto, 1/30/86.

*Primary Examiner*—James J. Bell

[57] ABSTRACT

A nonwoven material comprises a lofted or loftable, particle-bonded nonwoven having fibres bonded together with an adhesive binder and containing functional particles (e.g. particles of a liquid-absorbent polymer) distributed therein and attached to the fibres by the adhesive binder.

12 Claims, 3 Drawing Sheets

NONWOVEN MATERIALS

FIELD OF THE INVENTION

The present invention relates to nonwoven materials that comprise a lofted or loftable, fibrous matrix and functional particles, e.g. particles of a superabsorbent polymer, held within the matrix.

BACKGROUND TO THE INVENTION

Conventionally, cellulose wadding or fluff pulp is employed as the primary absorbent material in absorbent products such as babies' disposable napkins, incontinence pads for adult use and catamenials. However, although such cellulose absorbents are inexpensive, their absorbency is not especially high.

In recent years, polymers have been developed that have a very high absorbency with respect to aqueous liquids. Thus, hydrophilic polymers have been developed that can absorb more than 15 parts by weight of water per part of polymer. It can be readily envisaged that the partial or complete substitution of these so-called superabsorbent polymers for the cellulose absorbents that have been widely used hitherto might offer significant advantages by permitting the production of absorbent products that have increased absorbency and/or lower bulk. However, it has proved difficult to incorporate superabsorbent polymers into absorbent products in a satisfactory manner.

One problem with such superabsorbent polymers is that they should be prevented from coming into contact with the skin of the user of the absorbent product. Two techniques for overcoming that problem have been proposed in the art. The first technique involves the coating of one surface of a layer within the absorbent product with a hot-melt adhesive and bonding the particles of superabsorbent polymer into the product by means of that adhesive. The second technique is to confine the superabsorbent polymer particles by means of tissue paper. However, both of these techniques have the disadvantages that they involve additional expense (due to the cost of the extra material, namely the hot-melt adhesive or the tissue paper, as the case may be) and that the efficiency of the superabsorbents is impaired. Thus, whereas the hot-melt adhesive will block part of the surface area of the superabsorbent particles in the first of these prior-art proposals, the tissue paper used in the second of the proposals may provide the superabsorbent particles with insufficient space for swelling as they absorb moisture.

The prior-art proposals for incorporating superabsorbent polymers into absorbent products have generally involved the use of laminated structures. It is suggested in EP-A-0,202,472 that often the resulting products are easily delaminated with impaired absorbency. That European Patent Specification discloses a non-laminar absorbent product comprising matrix fibres (specifically cellulosic fibres or a mixture of cellulosic fibres and synthetic staple fibres) having a liquid-absorbing material (such as a superabsorbent polymer) bound within the matrix fibres by means of a heat-activated binder material. The binder may be thermoplastic or thermosetting and may, for example, be incorporated into the matrix in the form of a powder. In the exemplary embodiments of the process for producing the non-laminar absorbent product, matrix fibres are laid down in a first layer, a superabsorbent powder is evenly distributed thereover and a second layer of matrix fibres is laid down over that. Thus, in the continuous process illustrated therein, a mat is formed by laying down the matrix fibres on a web-forming device at two locations, a liquid-absorbing material being distributed amongst the matrix fibres at a location intermediate the said locations at which the matrix fibres are laid down. Such an arrangement is said to ensure that the absorbent is not exposed on one surface of the finished absorbent web (EP-A-0,202,472 at page 12, lines 18–27).

SUMMARY OF THE INVENTION

The present invention provides a nonwoven material that comprises a lofted or loftable, particle-bonded nonwoven, said nonwoven having a matrix of fibres that are bonded together with an adhesive binder, functional particles being distributed within the matrix and attached to the said fibres by means of the said adhesive binder.

The present invention also provides a process for producing a nonwoven material, wherein functional particles are distributed within a matrix of fibres containing an adhesive binder, said matrix forming a lofted particle-bonded nonwoven, and at least some of the functional particles contact the adhesive binder while the latter is in a molten or softened state. Preferably, the functional particles are applied to a loftable, particle-bonded nonwoven, and the nonwoven is thereafter subjected to heat so that it undergoes lofting. The resultant lofted nonwoven may then, for example, be either cooled in its lofted state or subjected to sufficient pressure to compact it into a denser, loftable material.

DESCRIPTION OF PREFERRED EMBODIMENTS

Figure 1:
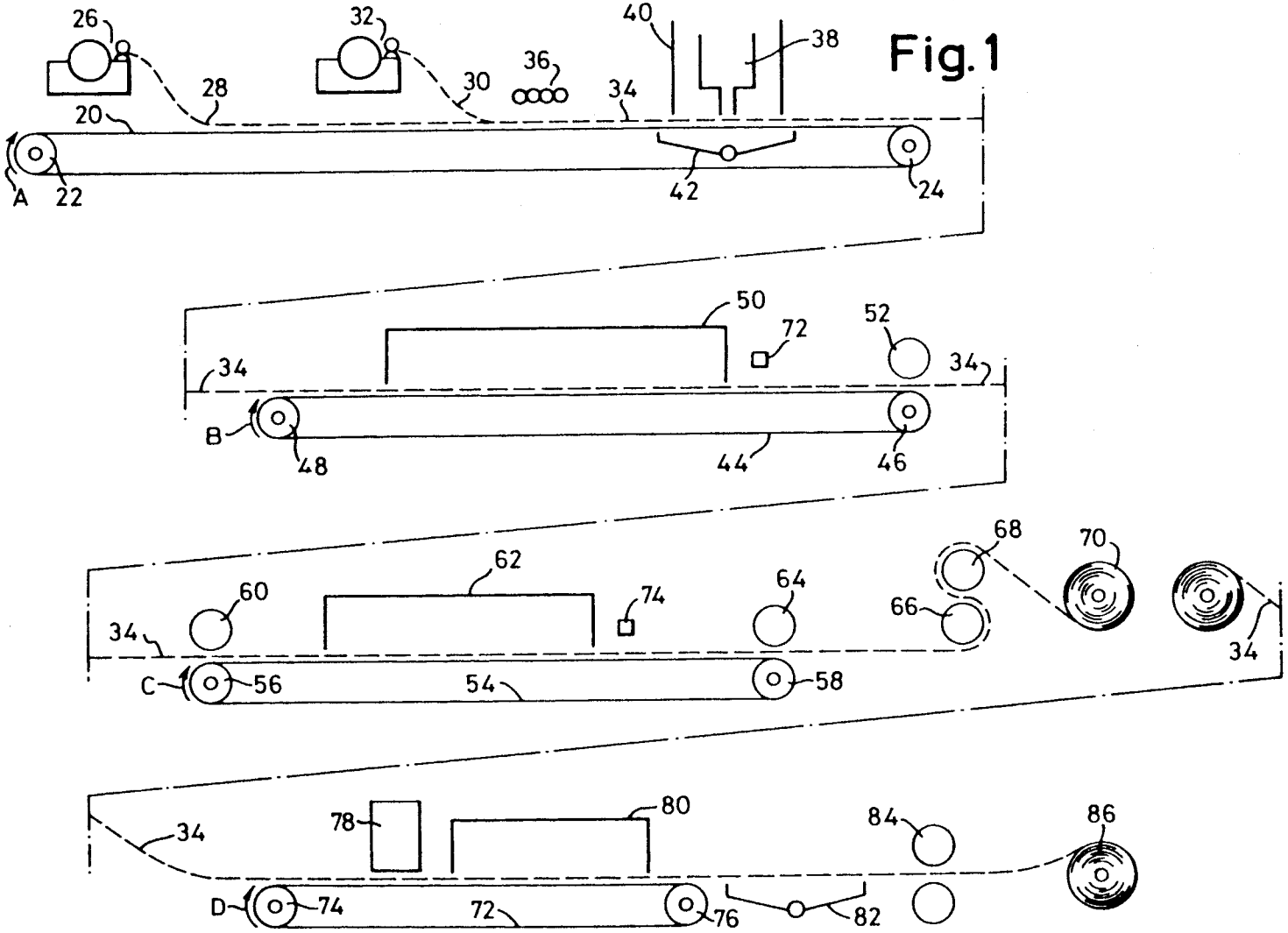
FIG. 1 is a flow-sheet showing various stages in the manufacture of an absorbent nonwoven material according to this invention.

The fibres in the nonwoven material may be selected, for example, from natural fibres (e.g. cotton linters), regenerated fibres (e.g. viscose rayon) and synthetic polymers (e.g. polyesters, such as poly(ethylene terephthalate), polyamides such as nylon 6 or nylon 6,6, and polyalkylenes such as polypropylene), as well as any mixtures of two or more such fibres. At present polyester fibres are preferred.

The fibres will have a staple length usually of from 25 to 100 mm, preferably from 35 to 60 mm, and a linear density usually of from 0.5 to 20 dtex, preferably from 1.5 to 15 dtex. Suitable fibre diameters will usually be from 1 to 50 μm, preferably 5 to 40 μm and typically 10 to 30 μm. However, the stated ranges for the aforesaid physical parameters should not be seen as limitative; the skilled person may select the fibre characteristics as appropriate for any given application.

The loftable nonwoven will usually have a basis weight of from 30 to 120 $g.m/^2$, preferably from 50 to 95 $g.m/^2$. The thickness of the loftable nonwoven will be typically from 0.25 to 1 mm.

The nonwoven material may be made using particles of bonding material of any suitable size and shape, for example the rods or granules disclosed, respectively, in U.S. Pat. Nos. 2,880,112 and 2,880,113 to A. H. Drelich. It is, however, preferred to employ nonwoven material produced using recent powder-bonding technology (see, for example, M. F. Meyer, R. L. McConnell and W. A. Haile, "Production of laminates and nonwovens by powder bonding", a paper presented at the INSIGHT '85 Advanced Forming/Bonding Conference, October, 27–29, 1985, Toronto, Canada, the teaching of which is incorporated herein by a reference). In a typical powder-bonding process, a layer of fibres is formed, preferably by dry-laying, a particulate bonding material is applied to the resultant layer and distributed therethrough, the resultant fibrous web is passed through a heating zone in which the particles are softened or melted, and the web is then passed through a zone in which it is compressed in order to increase the contact of the molten or softened bonding material with the fibres, after which the resultant material is cooled in order to solidify the bonding material and thereby to bond the fibres at points throughout the fibrous matrix.

The bonding powder should have a lower melting point than the fibres in the web; the bonding powder will commonly be of a material having a melting point in the range 80° to 180° C. In general, the bonding powder will be a thermoplastic material and it should be capable of forming a good adhesive bond with the fibres being used. In a number of cases, especially in the case of polyester fibres, a polyester bonding powder will be found to be suitable, for example the polyester powders available from Eastman Chemical Products Inc. as hot-melt adhesives under the trade mark "Eastobond". Typical polyester adhesives have melting points of from 110° to 130° C. and are available as coarse powders (200 to 420 μm or 70–40 U.S. standard mesh), medium powders (80 to 200 μm or 200–70 U.S. standard mesh) and fine powders (80 μm or less or finer than 200 U.S. standard mesh), the medium powders being preferred when the powder is to be added to the fibrous web using a mechanical applicator.

Other adhesive binders, for example epoxy resins, also come into consideration.

The amount of powder deposited in the web would usually be from 5 to 50% of the total fabric weight, preferably from 10 to 20%.

The required lofting capability may be achieved by the use of fibres that are crimped; suitable fibres include the crimped polyester fibres, for example such fibres having hollow cross-sections, that are marketed by Eastman Chemical Products Inc. for fibrefill applications. The lofting mechanism may be explained as follows. As laid, the fibrous web will be thick and of low density owing to the highly crimped form of the fibres that are used. When this web is treated with the bonding powder and then compressed (e.g. calendered) in the fabric-making process, the adhesive powder bonds hold down the fibres and constrain them in a flat sheet form. It is in this ("densified" or "compressed") form that the fabric is removed from the fabric-making line. The lofting process occurs when the adhesive powder bonds are softened by heat. The adhesive bonding material melts at a temperature (typically 110° to 130° C.) that is much lower than the melting temperature of the fibres (typically 250° to 290° C). When heated, therefore, the powder bonds soften and allow the fibres to "regain their memory" and thereby tend to return to the thick, low density form that they were in prior to adhesive bonding. Typically, the lofting temperature will be in the range of 120° to 220° C. The lofted material then cools in its lofted state and the adhesive resets and thereby stabilises the web in its lofted form.

Normally, the loftable material would be capable of an increase in thickness of typically 5 to 10 times the original thickness upon heating.

Suitable loftable powder-bonded nonwovens are marketed by Bonar Carelle Limited under the trade name "Carelle Ultraloft" in various grades, e.g. P50, with a basis weight of 50 g/m$^2$ and an unlofted thickness of 0.31 mm, and P95 with a basis weight of 95 g.m/$^2$ and an unlofted thickness of 0.61 mm. (Basis weights were measured by the EDANA 40-2-77 test method and thickness by the EDANA 30-3-78 test method.)

The expression "functional particles" includes, for example, functional powders and functional granules. The invention is not limited with regard to the particle shapes, although spherical and substantially spherical particles are at present preferred.

In certain preferred embodiments, the functional particles comprise or consist of hydrophilic polymers having the ability to absorb aqueous liquids, especially the so-called super-absorbent polyers. Numerous hydrophilic polymers are known, these mainly falling into three classes, namely the starch graft copolymers, the cross-linked carboxymethyl cellulose derivatives and the modified polyacrylates, particular sub-classes being carboxylated cellulose, hydrolyzed acrylonitrile-grafted starch, acrylic acid derivative polymers, polyacrylonitrile derivatives, polyacrylamides and saponified vinyl acetate/methyl acrylate copolymers.Commercially available superabsorbents include the polymers available under the trade mark "Water Lock" (Grain Processing Corporation, U.S.A.), and which are described in U.S. Pat. No. 3,661,815 and, amongst the acrylic acid and methacrylic acid polymers and copolymers, which are preferred herein, superabsorbent polymers are available under the trade marks "Sanwet" (Sanyo Kasei Kogyo K.K., Japan), "Sumika Gei" (Sumitomo Kagaku K.K., Japan) and "Aqua Keep" (Norsolor, France). The particles of hydrophilic polymer, before absorption of water, preferably have a weight-average particle size of from 75 to 800 μm, more preferably from 100 to 500 μm.

Research by the present Applicant suggests that it is possible to add up to 300% of superabsorbent relative to the weight of the nonwoven (e.g., up to 150 g/m$^2$ superabsorbent within a nonwoven having a basis weight of 50 g.m/$^2$). However, at such high levels, there may be a deterioration in the absorption efficiency and it is preferred to utilise addition levels of from 20 to 100% by weight of the nonwoven.

It will be understood, however, that the present invention is not limited to the us of functional particles that are liquid-absorbing polymers. Other functional agents in particulate form that could be used include, for example, activated charcoal (e.g. for absorbing odours and/or absorbing micro-organisms), medicaments, including antibacterial or antimycotic agents (for instance, in applications where slow release of the medicament is required); and metallised microspheres (for rendering the nonwoven X-ray detectable).

The loftable nonwoven may be constituted by the loftable phase of a two-phase nonwoven, the other phase being non-loftable, as disclosed in copending European Patent Specification No. 0,269,380 A2 (the teaching of which is incorporated herein by reference). Such two-phase materials are advantageous, in that they eliminate the need for the coverstock conventionally used in such absorbent products as diapers and the like, since the non-loftable phase provides an acceptable surface for presentation to the skin of the user. As described in European Patent Specification No. 0,269,380 A2 an absorbent layer is sandwiched between the two-phase nonwoven (adjacent to the loftable phase of the latter) and an impermeable backing sheet, the said loftable phase acting as a "dry bridge" to inhibit re-wetting of the surface by the absorbed liquid. However, the present invention offers the possibility of dispensing with the discrete absorbent layer, since a liquid-absorbing particulate material may now be incorporated within the loftable or lofted phase itself. The distribution of the liquid-absorbing (or, indeed, other functional) particles within the lofted phase may be uniform or even (or substantially so) or it may be differential with, for example, the concentration of the particles being at its lowest (e.g. substantially zero concentration) at the interface with the non-loftable layer, increasing to the greatest value adjacent the surface remote from the non-loftable phase. Usually, the non-loftable phase will be kept free or substantially free of the liquid-absorbing (or other functional) particulate material; this is due to the much more closed nature of the structure in this phase.

Usually, the non-loftable phase will have a basis weight (or "grammage") of from 10 to 50 $g.m/^2$, preferably 15 to 25 $g./m^2$. The loftable phase (i.e. in its densified form) may have a basis weight in the broad range, 30 to 20 $g.m/^2$, indicated above; however, typically the loftable phase will have a basis weight of from 30 to 80 $g.m/^2$, preferably from 50 to 60 $g.m/^2$. The thickness of the non-loftable phase will be typically from 0.03 to 0.25 mm, whereas the thickness of the loftable phase (in its densified form) will be typically from 0.25 to 1 mm.

As indicated in European Patent Specification No. 0,269,380 A2, it is also possible to construct a multiphase nonwoven material having three or more phases, at least one of which is a lofted or loftable phase.

By way of illustration, the production of a nonwoven material according to the present invention is described below with reference to the production line shown schematically in FIG. 1.

This production line comprises an open-mesh conveyor belt 20 which is driven around the rollers 22, 24 in the direction indicated by the arrow A. One or more textile cards—represented by the single device 26—are provided in order to deposit a layer 28 of fibres on the upper flight of the conveyor belt 20. The layer 28 constitutes a precursor of the loftable nonwoven.

If a two-phase nonwoven is required, another layer 30 of fibres is deposited on top of the layer 28 from one or more further textile cards, represented by the single device 32. In such cases, the layer 28 may constitute the precursor of either the loftable or the non-loftable phase of the nonwoven, the layer 30 constituting the precursor of the other phase. With this method of manufacture, there will be a measure of interpenetration of fibres from the two phases at the junction thereof, this being regarded as an asset in that it helps to preserve the integrity of the nonwoven sheet material during shipping, conversion into the end product and use.

A single-layer or two-layer web, now identified by the reference numeral 34, is passed through a web-spreading section 36 and then to a zone in which the powdered bonding material is applied to the web. This zone is represented by the powder-depositing device 38 (although in practice a plurality of such devices may be used). Suitable powder-depositing devices are powder applicators of the known type in which a wired roller takes powder into the space between the wires and, upon rotation, drops the powder out of that space onto the fibrous web passing beneath it. A screw 40 may be provided in order to raise or lower the roller of the powder-depositing device 38. Furthermore, a receptacle 42 is provided in order to catch any excess powder that falls through the open-mesh belt 20, the powder so collected being available for recycling.

It will be appreciated, of course, that as an alternative to mechanical powder-depositing devices, other applicators such as a fluidising air spray or an electrostatic spray-gun come into consideration, as do devices that apply the powder in a liquid carrier or in the form of a foam.

The web 34, now with bonding powder distributed through it, is transferred from the conveyor belt 20 to a further conveyor belt 44, for example of Teflon coated fibreglass, which belt 44 is driven round rollers 46, 48 in the direction indicated by the arrow B and serves to carry the fibrous web 34 through an infrared oven 50. Within the oven 50, the bonding powder fuses and bonds the fibres of the web at points where the fibres and the bonding material come into contact. Upon leaving the oven 50, the web 34 is subjected to light pressure by means of the nip roll 52.

It has been found that the strength of the web material can be improved by reheating. Accordingly, the web 34 leaving the nip roll 52 is transferred to another conveyor belt 54 which is driven round rollers 56, 58 in the direction indicated by the arrow C. As it contacts the conveyor belt 54, the web 34 is carried beneath a water-cooled lightweight roller 60. The web is then carried through a second oven 62 and thereafter is subjected to further compression by means of the nip roll 64. The nip rolls 52 and 64 may be heated during start-up but thereafter cooled during operation. The rollers 46, 48 and 56, 58 may also be water-cooled in order to prevent an excessive build-up of temperature due to the transfer of heat from the ovens. The resultant web is then further cooled by passing it around the water-cooled cans 66, 68, following which the web is wound into roll 70 on a suitable winder.

The suitable oven temperatures will depend upon the bonding powder that is used and will be ascertainable from simple trials or from the literature provided by the supplier of the bonding powder. Typically, however, the oven temperatures will be within the range from 80° to 200° C. The temperature of the web emerging from the ovens 50 and 62 may be monitored, for example by means of infrared devices 72 and 74, respectively. It will be appreciated, of course, that the infrared ovens 50, 62 could be replaced by other heating devices, e.g. calenders, hot-air ovens, steam presses and heated contact cans with non-stick surfaces. The dwell time of the web in each oven will depend upon the line speed that is achievable (typically from 50 to 100 meters per minute, although higher speeds may be possible) and other factors, but may typically be from 20 seconds to 2 minutes.

The pressures applied by the nip rolls 52 and 64 will depend upon the materials used, the desired characteristics of the web and the process line conditions; normally, pressures of up to 30 kg, typically up to 20 kg, per cm of roll face width are used.

Clearly, a given volume can contain a greater weight of unlofted material than lofted material and it is therefore preferred, for reasons of economy, to transport and store the sheet material in the unlofted state prior to further processing.

As required, densified web 34 (or a two-phase web containing a densified, loftable phase) is fed on to a conveyor which is represented by (but not necessarily limited to) a conveyor belt 72 which is driven round rollers 74, 76 in the direction indicated by the arrow D. The web 34 may be fed from a roll 70 of the material; alternatively, it could, in principle, be obtained directly from the water-cooled cans 66,68. The conveyor 72 serves to carry the fibrous web 34 through a zone in which functional particles may be applied to the web from an applicator device 78. In the case of a two-phase web it is preferred to apply the particles to the loftable phase. The particulate material may be supplied from a fluidized bed powder hopper by means of a venturi-effect powder pump to a spray gun of the electrostatic type or compressed-air type (e.g. the Flexi-Spray (trade mark) powder gun manufactured by Nordson Corporation, Ohio, U.S.A). Other equipment suitable for the application of particles of liquid-absorbent polymer utilizes a dosing roller and is available from Santex AG, Tobel, Switzerland.

By adding the functional particles at this stage, rather than earlier in the process, the possibility of interference with the fibre-to-fibre bonding is largely avoided; moreover, the functional particles are not subjected to the earlier heating and high-pressure calendering stages, which might have damaged them.

Usually, it is preferred to achieve a uniform or substantially uniform distribution of particles through the web. However, it is possible to achieve a differential distribution, for example by use of a vibratory system and/or by means of an appropriate selection of fibre characteristics and particle sizes of the functional particles.

The dense web to which the functional particles have been applied is then passed through an oven 80 which is maintained at a temperature at which lofting of the loftable web (or phase) will occur. As the lofting process is activated, the functional particles tumble into the opening fibrous structure. Only those particles attaching to the molten or softened adhesive are retained. The lofted web emerging from the oven 80 (which may be, for example, of any of the types mentioned above as being suitable for the oven 50 or 62) comprises a matrix of fibres with the functional particles distributed through the matrix and attached to the fibres by means of the adhesive. The particles are retained predominantly in the spaces within the low density open structure.

A collection device 82 may be provided immediately after the conveyor 72 in order to collect unbonded particles that have dropped through or spilled over the web. The lofted material emerging from the oven 80 could, after cooling, be used as such for conversion into the desired end product, for example a disposable diaper. However, the nonwoven has normally to be transported to the converter and, in order to reduce transport costs, the web will ordinarily be fed to a calander 84, or a similar device, in order to re-densify it, the resultant dense material then being wound into a roll 86 on a suitable winder. The re-densified nonwoven may be lofted again, when required, by the application of heat (as described above).

Figure 2:
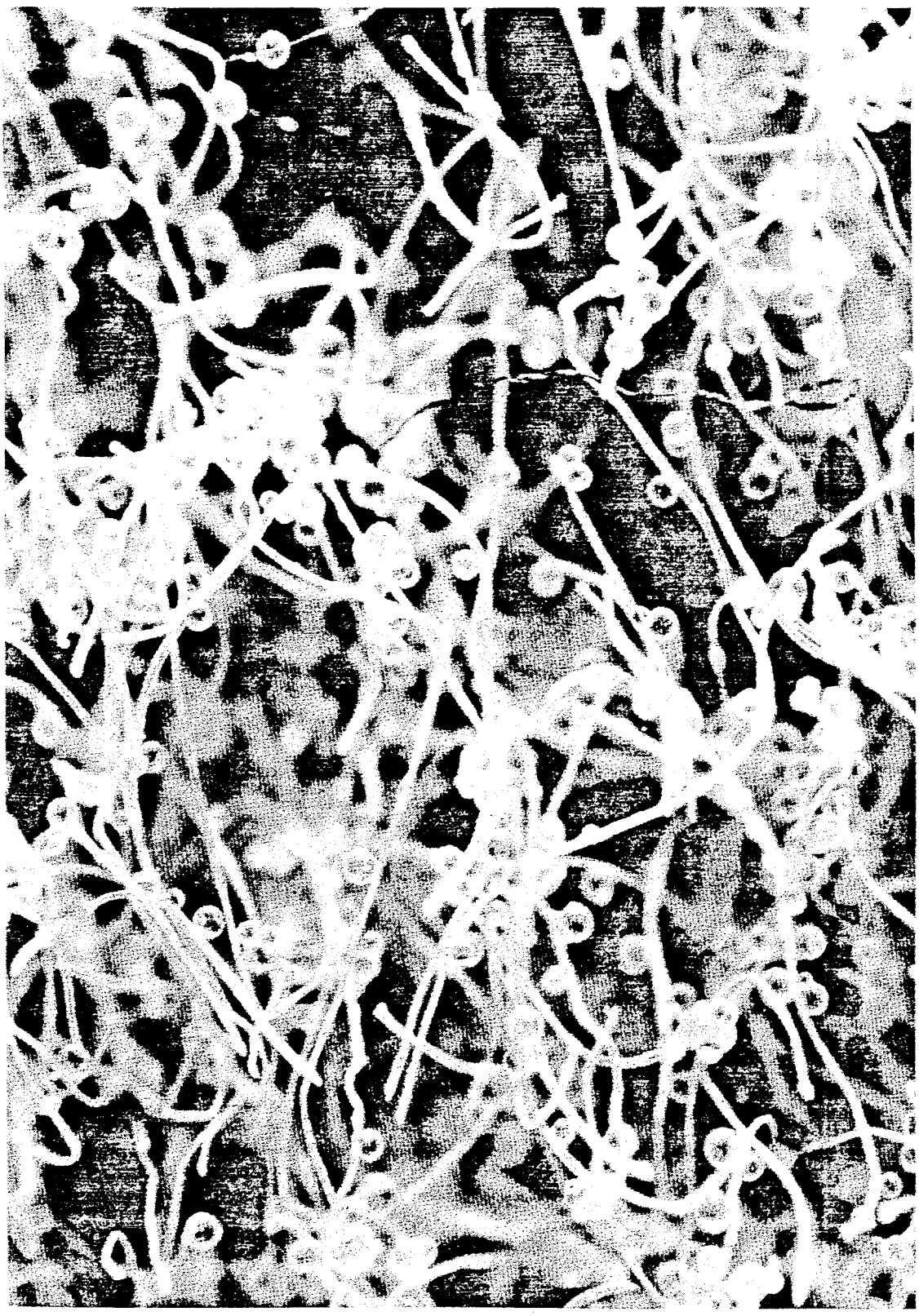
FIG. 2 is a photomicrograph of a section through an absorbent nonwoven material according to this invention.
Figure 3:
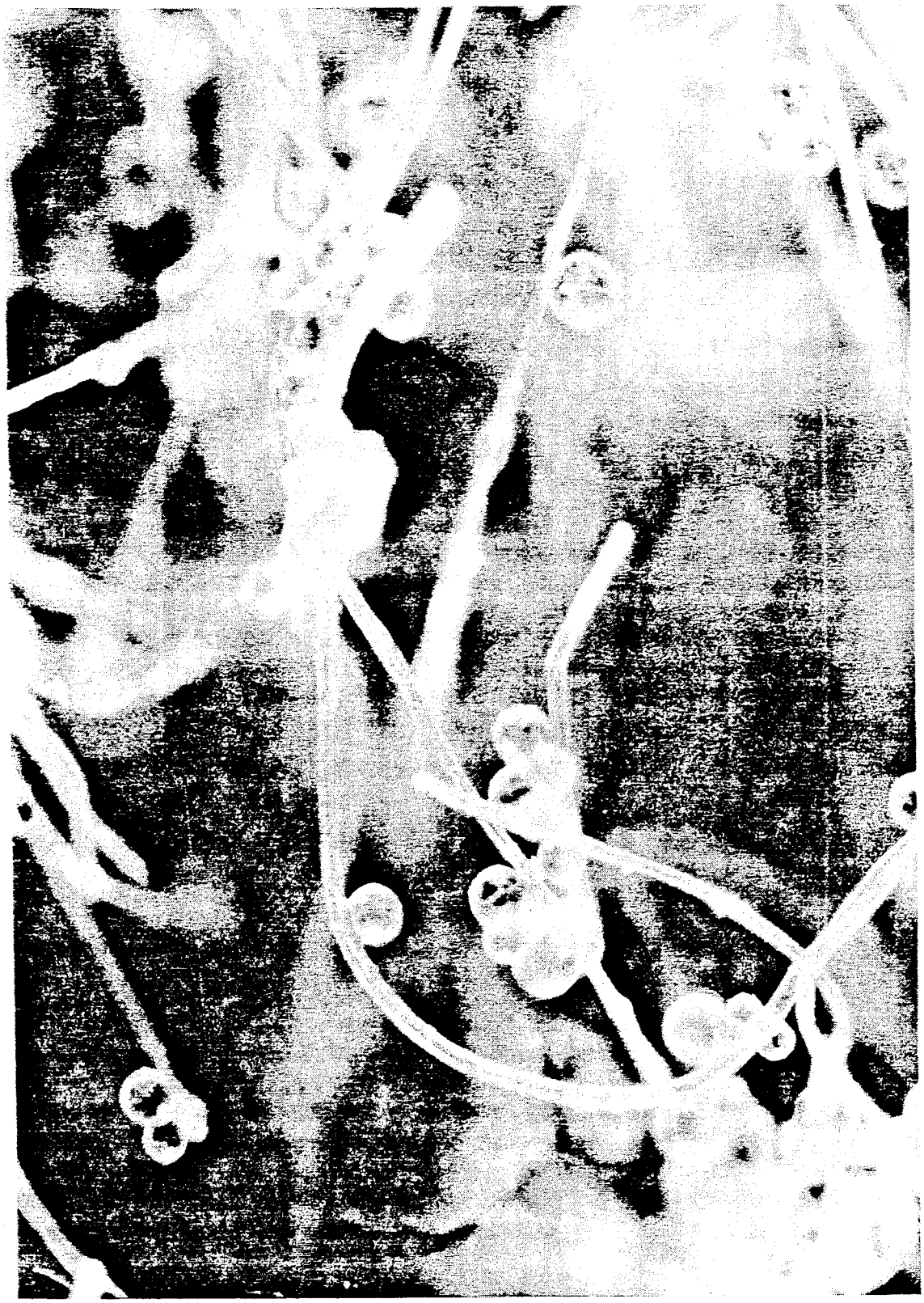
FIG. 3 is a photomicrograph of a section through an absorbent nonwoven material according to this invention at a higher magnification than that of FIG. 2.

The manner in which the functional particles may be distributed and fixed within a lofted nonwoven is shown in FIGS. 2 and 3, which are photomicrographs, at magnification x33 and x84 respectively, of an Ultraloft polyester nonwoven bonded with an Eastobond polyester binder and having distributed therein particles of a superabsorbent polymer.

The matrix of fibres, especially in the lofted (or "bulked" or "uncompressed") state, allows ample volume within which the superabsorbent polymers may expand when absorbing a liquid. Furthermore, the superabsorbent particles are attached to the binder over a comparatively small proportion of their total surface area. These factors, together with the good distribution of the particles through the fibrous matrix, enable the superabsorbent polymer to absorb liquid in a highly efficient manner. Moreover, since the nonwoven is an integrated structure, there is little or no tendency to undergo delamination and, once the unbonded and overspill particles have been removed, the remaining particles are in general sufficiently well bonded to avoid substantially the migration of loose particles within the nonwoven and the loss of loose particles from the nonwoven. The low incidence of large clusters or localised heavy concentrations of particles contributes to the efficiency of the absorption, since the phenomena such as gel-blocking (whereby, for instance, particles interfere with the absorption capability of other particles) are largely avoided.

The absorbent nonwoven material may be converted by conventional means into the desired end product, such as a disposable absorbent product of the class that may be broadly described as "diapers", for example babies' napkins, incontinence pads for adult use and catamenial products. Commonly, the conversion will involve the attaching of the nonwoven material to a liquid-impermeable backing sheet, for example by means of stitching or the use of an adhesive material. The absorbent product may be constructed in a conventional manner, using a coverstock layer; however, it is preferred to employ a two-(or other multi-) phase nonwoven, as described above. Other components, e.g. fastening tapes or the like, may be attached if required.

It will be appreciated, of course, that the absorbent products of the present invention could be used outside the field of disposable personal hygiene aids. For instance, the products may be used in the medical field, as bandaging or as wound dressings (subject to approval by the appropriate regulatory body), or as wipes.

Further possible end uses for nonwoven materials according to this invention may be in durable or semi-durable goods, for instance neutralising agents in filtration, barrier agents in screening applications (eg. surveillance or interference), insulation, and in the construction of protective layers around sensitive equipment within environmentally controlled areas.

It will of course be understood that the present invention has been described above purely by way of example, and modification of detail can be made within the scope of the invention.

I claim:

1. A nonwoven material containing a lofted or loftable particle-bonded nonwoven fabric, said fabric comprising (1) a matrix of fibers bonded together with a particulate adhesive binder and (2) functional particles distributed within said matrix and attached thereto by means of said particulate adhesive binder.

2. A nonwoven material according to claim 1 wherein said matrix comprises polyester fibers.

3. A nonwoven material according to claim 2 wherein said particulate adhesive binder is a polyester bonding powder.

4. A nonwoven material according to claim 3 wherein said functional particles comprise a liquid-absorbent polymer.

5. A nonwoven material according to claim 4 wherein said liquid-absorbent polymer is a starch graft copolymer, a cross-linked carboxymethyl cellulose derivative or a modified polyacrylate.

6. A nonwoven material according to claim 4 wherein said liquid-absorbent polymer is a superabsorbent polymer.

7. A nonwoven material according to claim 6 wherein said superabsorbent polymer is an acrylic or methacrylic acid-containing polymer.

8. A nonwoven material according to any one of claims 1-7, inclusive, which also contains, in contiguous interfacing relationship with said matrix, a nonloftable nonwoven material.

9. A nonwoven material according to claim 8 wherein said functional particles are distributed substantially evenly throughout said matrix.

10. A nonwoven material according to claim 8 having a differential distribution of said functional particles within said matrix.

11. A nonwoven material according to claim 10 wherein the concentration of said functional particles is at its lowest at the surface of said matrix adjacent the interface with said nonloftable nonwoven material and at its greatest adjacent the surface of said matrix remote from said interface.

12. A disposable absorbent product comprising a nonwoven material according to claim 1 in the form of a baby's diaper, an incontinence pad for adult use, a sanitary napkin or tampon, a bandage, a medical dressing or a wipe.

* * * * *